US005371985A

United States Patent [19]

Suttles

[11] Patent Number: 5,371,985

[45] Date of Patent: Dec. 13, 1994

[54] MODULAR BUILDING STRUCTURE

[75] Inventor: J. Marshall Suttles, Elberton, Ga.

[73] Assignee: AWH Corporation, Winston-Salem, N.C.

[21] Appl. No.: 42,748

[22] Filed: Apr. 5, 1993

[51] Int. Cl.[5] ..... E04B 2/82

[52] U.S. Cl. ..... 52/126.1; 52/239; 52/263; 52/264; 52/480

[58] Field of Search ..... 52/126.1, 239, 263, 52/264, 480

[56] References Cited

U.S. PATENT DOCUMENTS

| | | | |
|---|---|---|---|
| 3,324,614 | 6/1967 | Loewenau | 52/263 |
| 3,640,036 | 2/1972 | Nakazawa et al. | 52/263 |
| 3,774,582 | 10/1969 | Wah et al. | 52/263 |
| 4,242,970 | 1/1981 | Suttles et al. | 52/239 |
| 4,854,099 | 8/1989 | Kristoffersen | 52/480 |
| 5,048,242 | 9/1991 | Cline | 52/263 |

*Primary Examiner*—Carl D. Friedman
*Assistant Examiner*—Christopher Todd Kent
*Attorney, Agent, or Firm*—Howson and Howson

[57] ABSTRACT

A modular building structure for converting an existing building interior to a convenience store or the like comprises a grid made up of a first set of parallel metal tubes supportable by levelers on an existing floor, and a second set of parallel metal tubes supported on, and extending orthogonally to, the tubes of the first set. Rectangular metal floor panels are supported on the grid. The panels have aprons along two opposite edges for resting on tubes of the first set, and the other two edges rest on tubes of the second set. The grid tubes are engaged with feet extending horizontally from upright, wall-panel supporting posts. The feet are identical and each is adapted to receive and support grid tubes of either set.

17 Claims, 9 Drawing Sheets

MODULAR BUILDING STRUCTURE

BRIEF SUMMARY OF THE INVENTION

This invention relates generally to modular building structures, and more particularly, to a modular building structure especially adapted for use in converting the interior, or part of the interior, of an existing building to a convenience store.

The interior of a convenience store should have a new, clean and pleasing appearance in order to attract customers. The interiors of existing buildings, such as older automotive service station buildings, can be converted to convenience stores by conventional techniques, involving the laying of conventional flooring and the erection of conventional wall and ceiling structures. However, the conversion is expensive. Furthermore, the new interior, once constructed, is difficult to modify. Even though modifications to the floor, walls, shelving, electrical outlets and fixtures, and plumbing are desirable from time to time, owners are deterred from making such desirable modifications by the high expenses entailed, and by the lengthy amounts of time required to effect the modifications.

It is common practice for the proprietor of a convenience store to rent space in an existing building. The interior of the building usually requires numerous improvements to meet the needs of the proprietor. For instance, the existing floor and walls may need to be replaced with a new floor and new walls. However, if the improvements are permanently affixed to the building structure, the improvements must be left behind by the proprietor upon termination of the lease. This is a particularly acute problem in localities in which short-term leases are customary, since the useful life of the interior structure may far exceed the term of the lease.

The general object of this invention is to overcome one or more of the foregoing problems. One important specific object of this invention is to provide a novel modular building structure for a store interior which can be assembled rapidly and inexpensively. Another object of the invention is to provide a modular building structure for a store interior, which can be quickly and inexpensively modified. Still another object of the invention is to provide a modular building structure for a store interior, which can be easily, quickly and inexpensively disassembled and moved for use at another location. A still further object of the invention is to provide a simple and inexpensive building structure which can be used to convert substantially any existing building interior to a store interior having a new, clean and pleasing appearance.

This invention addresses the foregoing objects by a modular building structure which comprises a grid adapted to be supported on, and situated above, and in spaced relationship to, a preexisting floor, and a plurality of substantially rectangular floor panels supported on the grid. The grid comprises a first set of straight, rigid elements extending horizontally in parallel, uniformly spaced relationship to each other, and a second set of straight, rigid elements extending horizontally in parallel, uniformly spaced relationship to each other. The grid elements of the second set extend orthogonally to the elements of the first set, and are supported by the elements of the first set. Each of the floor panels has a first pair of opposite edges, and a second pair of opposite edges. The floor panels are supported in edge-to-edge relationship with one another and the edges of the second pair rest on adjacent elements of the second set. Clips, located at the intersections of the grid, releasably secure the floor panels against horizontal movement relative to the grid. Each such clip has a first channel for receiving one of the rigid elements of the first set, and a second channel for receiving one of the elements of the second set, so that the clip is prevented from moving horizontally relative to the received elements. Depending, grid-engaging aprons extend along the first pair of edges of each floor panel. The aprons rest on adjacent grid elements of the first set and cooperate with the clips so that horizontal movement of the floor panels is prevented. Grid levelers are attached to the first set of grid elements for adjustably leveling the grid.

Upright wall supporting posts are provided at intervals around the periphery of the floor structure. Sheet metal-framed wall, window and door modules are removably connected between the upright posts by means of clips. The uprights are provided with shelf-supporting slots which permit shelving to be mounted at any desired positions on the walls.

Each upright post is provided with a foot for engagement with the end of one of the floor-supporting grid elements. The grid elements of second set are higher above the pre-existing floor than are the grid elements of the first set. However, each foot is capable of receiving grid elements of either set. Therefore, all upright posts can have identical feet. Preferably, each foot has two channels: a lower channel, spaced from the upright post, capable of receiving and supporting the end of an element of the first set, and an upper channel, closer to the upright post, capable of receiving and supporting the end of an element of the second set.

The grid-supported floor and the upright-supported walls form a sturdy, easily assembled, easily modified, and easily taken-down modular structure, especially suited for constructing convenience store interiors in existing buildings.

Further objects, features and advantages of the invention will become apparent from the following detailed description when read in conjunction with the drawings.

DETAILED DESCRIPTION

Figure 1:
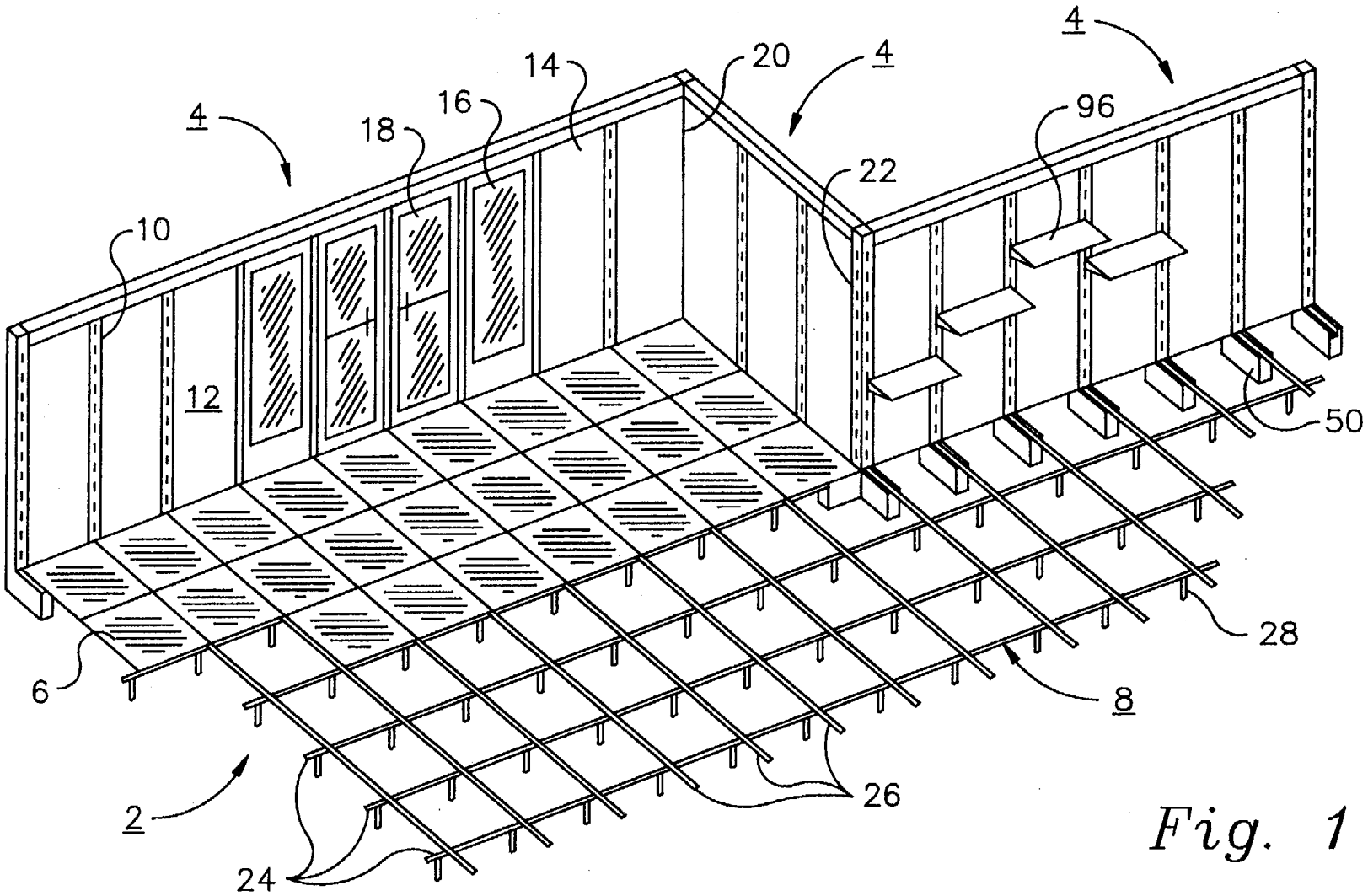
FIG. 1 is a fragmentary perspective view showing a portion of a partially assembled modular building structure in accordance with the invention, with a part of its floor panel-supporting grid exposed.

The modular building structure in accordance with the invention can provide a new interior for an existing building. FIG. 1 shows a modular building structure comprising a floor assembly 2 and walls 4. Floor assembly 2 comprises a set of identical floor panels 6 supported above a pre-existing floor by a grid structure 8. Upright, wall module-supporting posts 10 are provided, preferably at regular intervals, along the edges of floor assembly 2. These upright posts 10 support wall modules 12, and are connected to ends of the elements of grid 8.

Grid 8 can be assembled in any of a wide variety of sizes and configurations to provide a floor having any desired shape and size. Each wall module 12 comprises a sheet metal frame which can be provided with panels to produce a wall section 14, or with a window 16 or a door 18. The modules are preferably provided with both inner and outer faces spaced from each other. Insulating material can be provided between the faces, if desired. With the upright posts 10 uniformly spaced from one another, doors 18 and windows 16 can be placed at any desired locations in the walls of the structure.

Specially configured upright posts are used to provide an inside corner 20 and an outside corner 22. Such corners can be provided to increase the wall area of the structure or to allow the modular structure to conform to the shape of the pre-existing building interior.

The raised floor allows easy placement of electrical wiring and plumbing lines underneath it. Floor panels 6, which are releasably supported by grid 8, providing easy access to wires and pipes running underneath the raised floor so that repairs and modifications can be effected easily. Electrical outlets and plumbing connections can be provided at any position within the enclosure, and can be moved to new positions readily. Additional outlets and connections can be installed readily as needed.

Grid 8 is made up of two sets of elements, all preferably in the form of steel tubes having a square cross-section. The straight, rigid elements of a first, or lower, set 24 extend horizontally, in parallel relationship to one another, and are uniformly spaced from one another. The straight, rigid elements of a second, or upper, set 26 also extend horizontally in uniformly spaced, parallel relationship, but orthogonal to the elements of the first set 24. The elements of set 26 are located on top of, and supported by, the elements of set 24. The lengths of the individual elements of tubing are selected in accordance with the desired dimensions of the floor of the modular structure. While the tubing can be cut to size on site, preferably it is shipped to the building site already cut to size.

It is important for floor assembly 2 to provide a level floor surface. Levelers 28, shown in FIGS. 1 and 3, extend between the lower grid elements 24 and the preexisting floor. Each leveler comprises a sheet metal box having extensions of its side walls spaced from each other at its upper end to provide a channel for receiving an element 26. Each leveler has a foot with an upwardly extending threaded shank threaded into a nut (not shown) fixed to the lower end of the box portion of the leveler. The height of each grid leveler 28 can be individually adjusted to compensate for an uneven or sloping, preexisting floor, so that the raised floor assembly 2 can be made nearly perfectly level.

Figure 10:
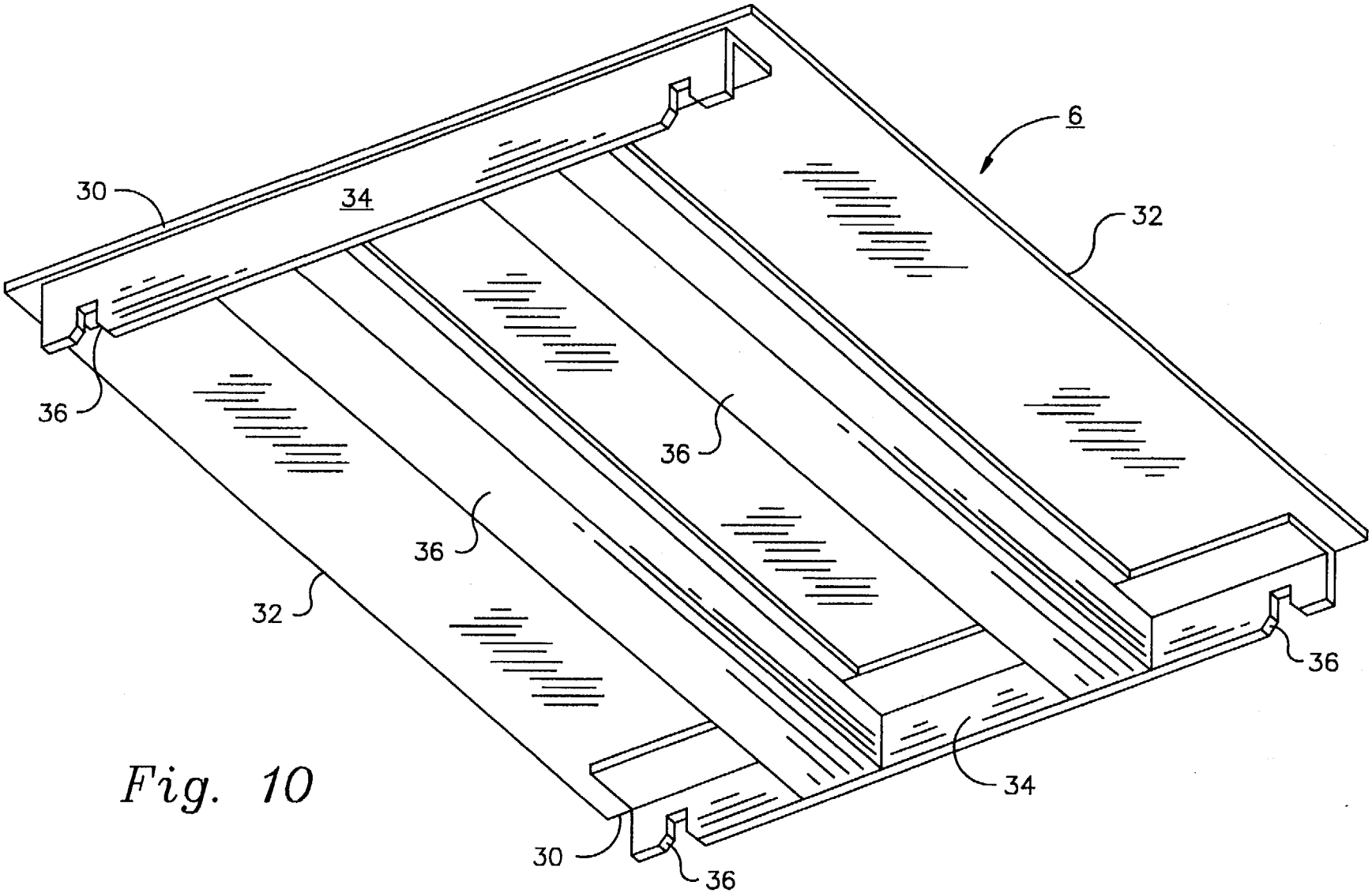
FIG. 10 is a perspective view showing the underside of a floor panel in accordance with the invention.

As shown in FIG. 1, rectangular floor panels 6 are supported in edge-to-edge relationship on grid 8. FIG. 10 shows the underside of a typical floor panel 6. The panel comprises a rectangular sheet, preferably square and preferably formed from a suitable gauge, e.g. 14 gauge, sheet steel, having a first pair of opposite edges 30 and a second pair of opposite edges 32. Angles, welded to the underside of the sheet, form aprons 34 which extend along the first pair of opposite edges 30 and depend from the sheet. Downwardly open slots 36 are located adjacent to the ends of each apron 34. Stiffeners 38 are welded to the underside of floor panel 6 to provide structural support. The stiffeners are preferably formed in a size such that their lowermost faces are flush with the edges of the aprons and therefore capable of resting on the lower grid elements 24. Rubber matting, vinyl tile, quarry tile, or other flooring materials (not shown) can be cemented or otherwise suitably secured to the top surface of steel floor panel 6.

Figure 2:
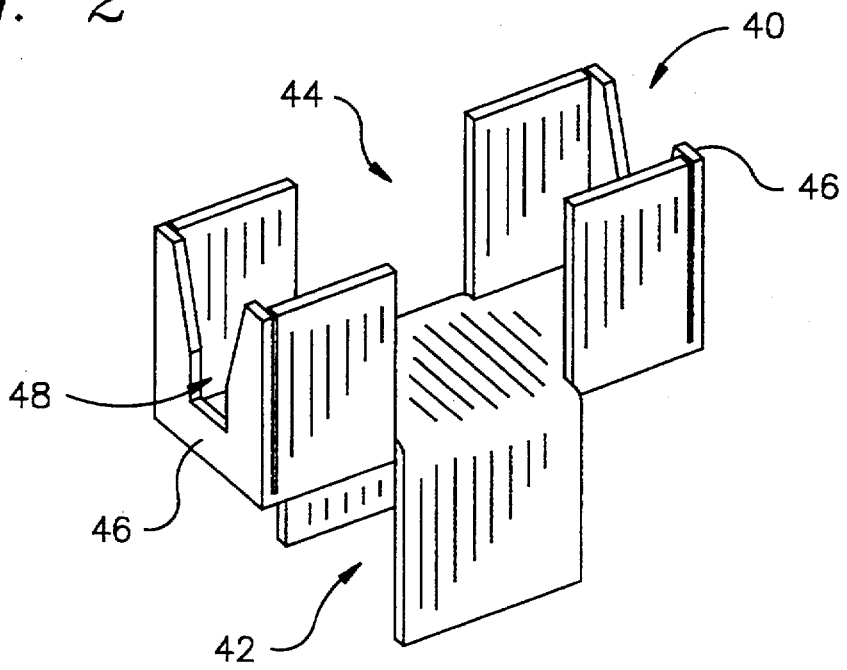
FIG. 2 is a perspective view showing a clip having channels for receiving grid elements and slots for receiving the aprons of flooring panels.

Referring to FIGS. 2–5, floor panels 6 are releasably secured against horizontal movement relative to the elements of grid 8 by clips 40. The clip 40, which is best seen in FIG. 2, is formed from a single, flat piece of sheet steel. Tabs extending downwardly from opposite sides of an intermediate portion of a central web form a first channel 42 for receiving a lower grid element 24. The space left by the absence of the downwardly extending tabs in the upwardly bent elements along the sides of the web provides a second channel 44 for receiving an upper grid element 26.

Figure 3:
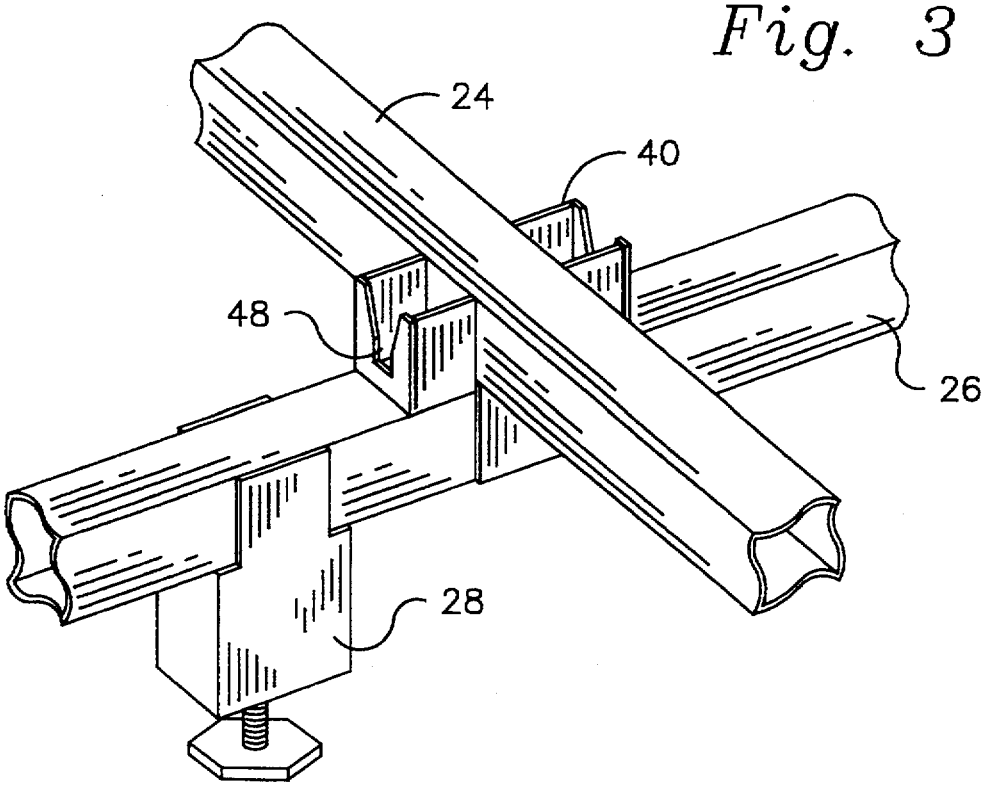
FIG. 3 is a fragmentary perspective view showing the intersection of two crossing grid elements, a clip engaging the two elements, and a grid leveler.

A clip 40 is provided at every intersection of the grid elements. FIG. 3 illustrates the engagement of a clip 40 with grid elements 24 and 26. Engagement of the clips with the orthogonally related grid elements prevents the clips from sliding horizontally on the grid elements. The clips, in turn, secure the floor panels 6 against horizontal movement relative to the grid and relative to one another.

End walls 46 of clip 40 define Y-shaped slots 48 which have tapered entrances on the upper edges of the end walls to facilitate engagement of the slots by the aprons of the floor panels.

Figure 4:
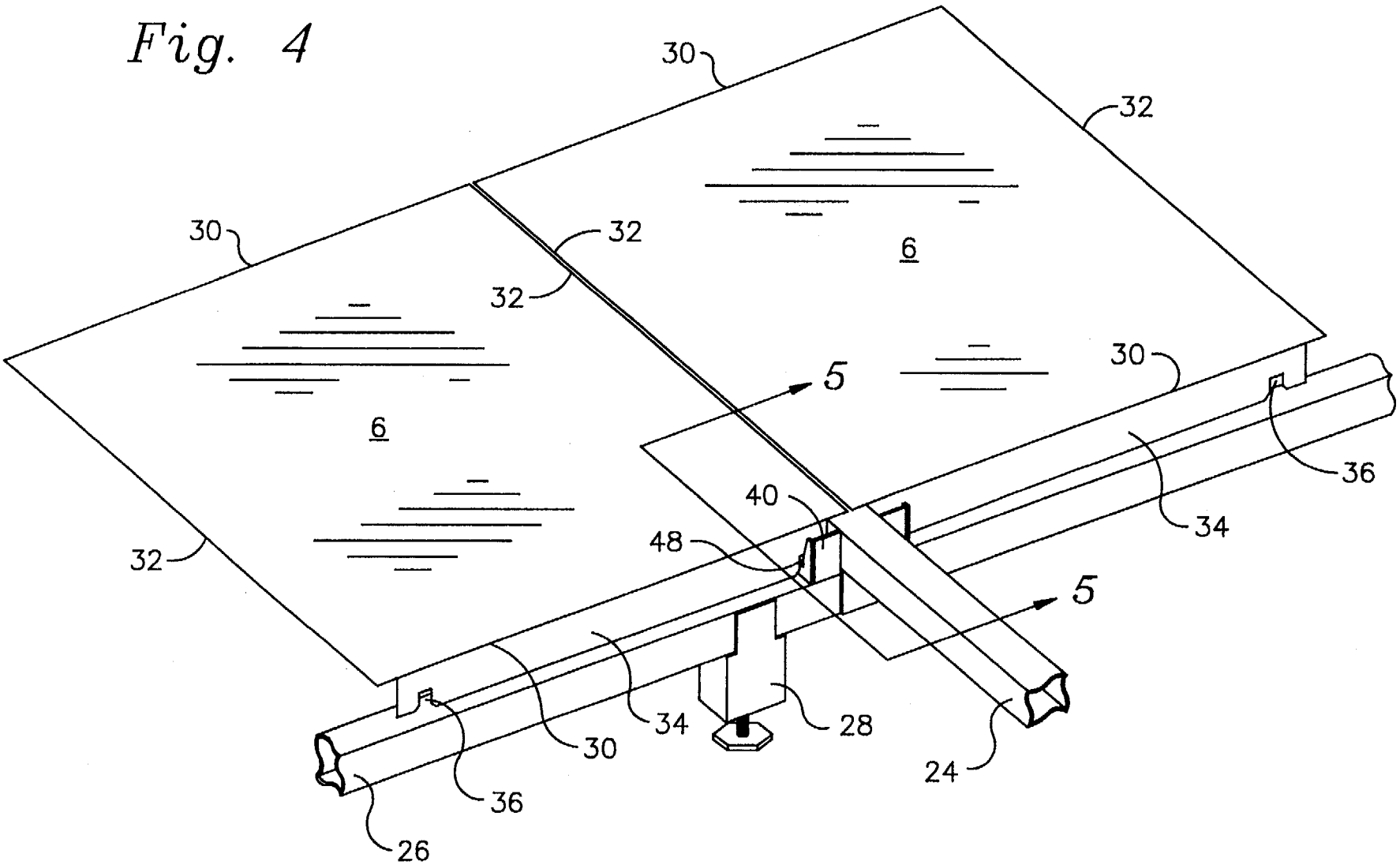
FIG. 4 is a fragmentary perspective view showing two floor panels supported by grid elements and secured against horizontal movement by a clip.
Figure 5:
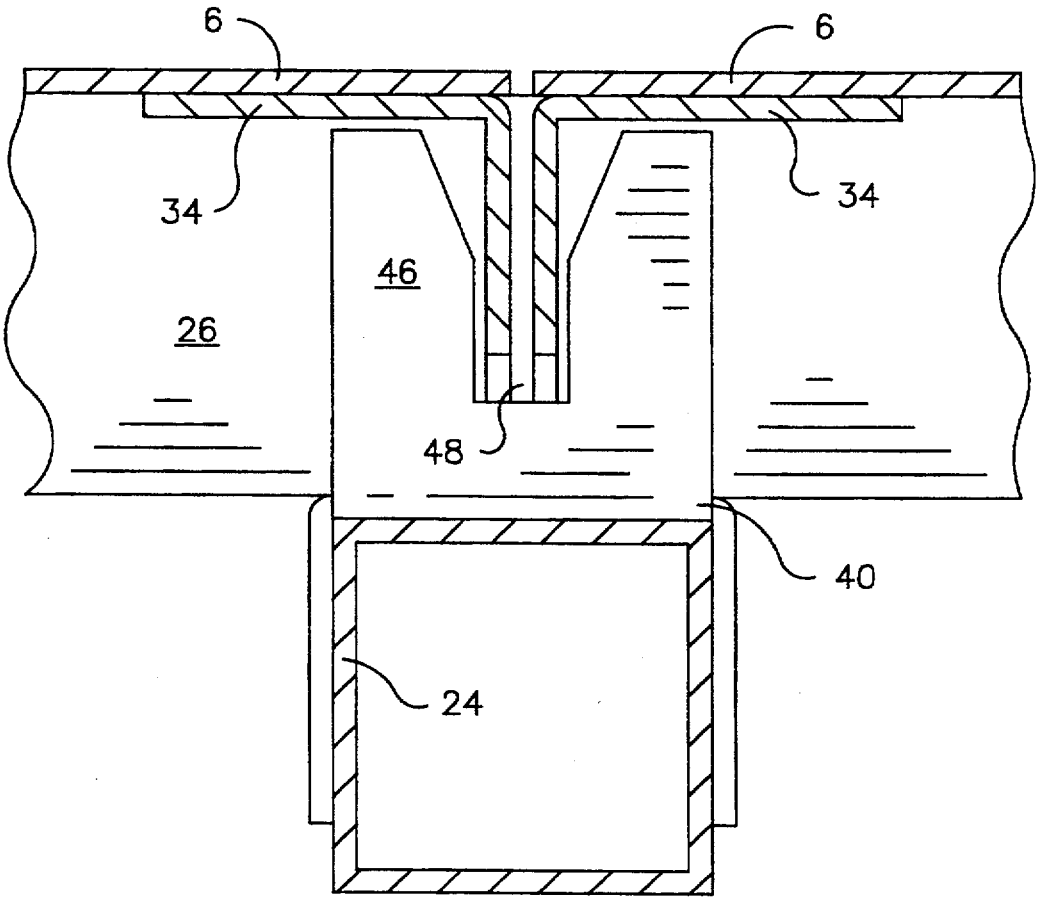
FIG. 5 is a sectional view taken on plane 5—5 of FIG. 4 to illustrate a slot of a clip in engagement with the aprons of two adjacent floor panels.

FIGS. 4 and 5 show the manner in which the clip 40 cooperates with the floor panels 6 and grid elements 24 and 26. Slots 48 of clip 40 receive the depending aprons 34 on the undersides of the floor panels to prevent the adjacent panels 6, shown in FIG. 5, from separating from each other in the direction of the length of grid element 24. Bevelled slots 36 in the aprons near their ends (see FIG. 10) receive portions of the end walls 46 of clips 42 to prevent the floor panels 6 from moving apart from one another in the direction of the lengths of the lower grid elements 26.

Aprons 34 physically contact and rest on the tops of grid elements 24, as shown in FIG. 4. The ends of stiffeners 36 (see FIG. 10) also rest on the tops of grid elements 24. Edges 32 of each floor panel 6 physically contact and rest on the tops of grid elements 26. Thus, each floor panels 6 is supported along on all four of its edges by the grid structure. Each edge of the floor panel is supported along a substantially continuous contact surface extending nearly the entire length of the floor panel edge.

With the floor panels all held tightly together by the clips, and each of the rectangular floor panels supported along all four edges, a firm, rigid, noise-free floor structure is achieved.

As shown in FIG. 1, a wall 4 is provided along the perimeter of the floor assembly 2. Each upright post 22 has a foot 50, preferably welded to it, and extending horizontally along the preexisting floor toward the interior of the modular building structure. The feet 50 provide support for the upright posts and are used to connect the upright posts 22 to ends of grid element 24 and 26.

All of the upright posts 22 preferably have identical feet 50. Each foot 50 is capable of receiving and supporting either a lower grid element 24 or an upper grid element 26. Consequently, the upright posts (except for the corner posts) can all be identical, and manufacturing and installation costs can be reduced accordingly.

Figure 7:
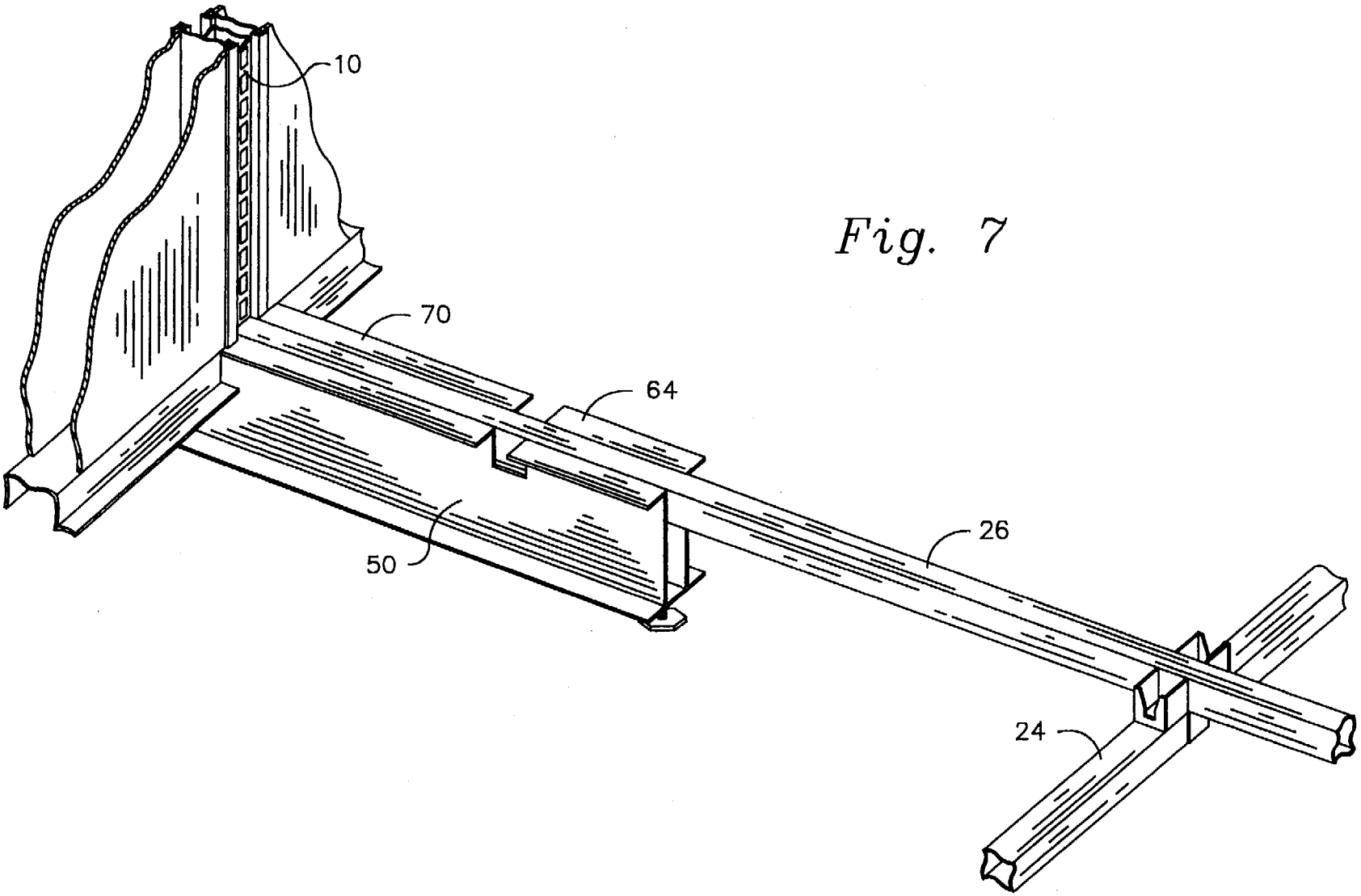
FIG. 7 is a fragmentary perspective view showing an upright post on one wall of the modular building structure, with a foot extending horizontally from the lower end of the upright post and receiving the end of an upper grid element.
Figure 8:
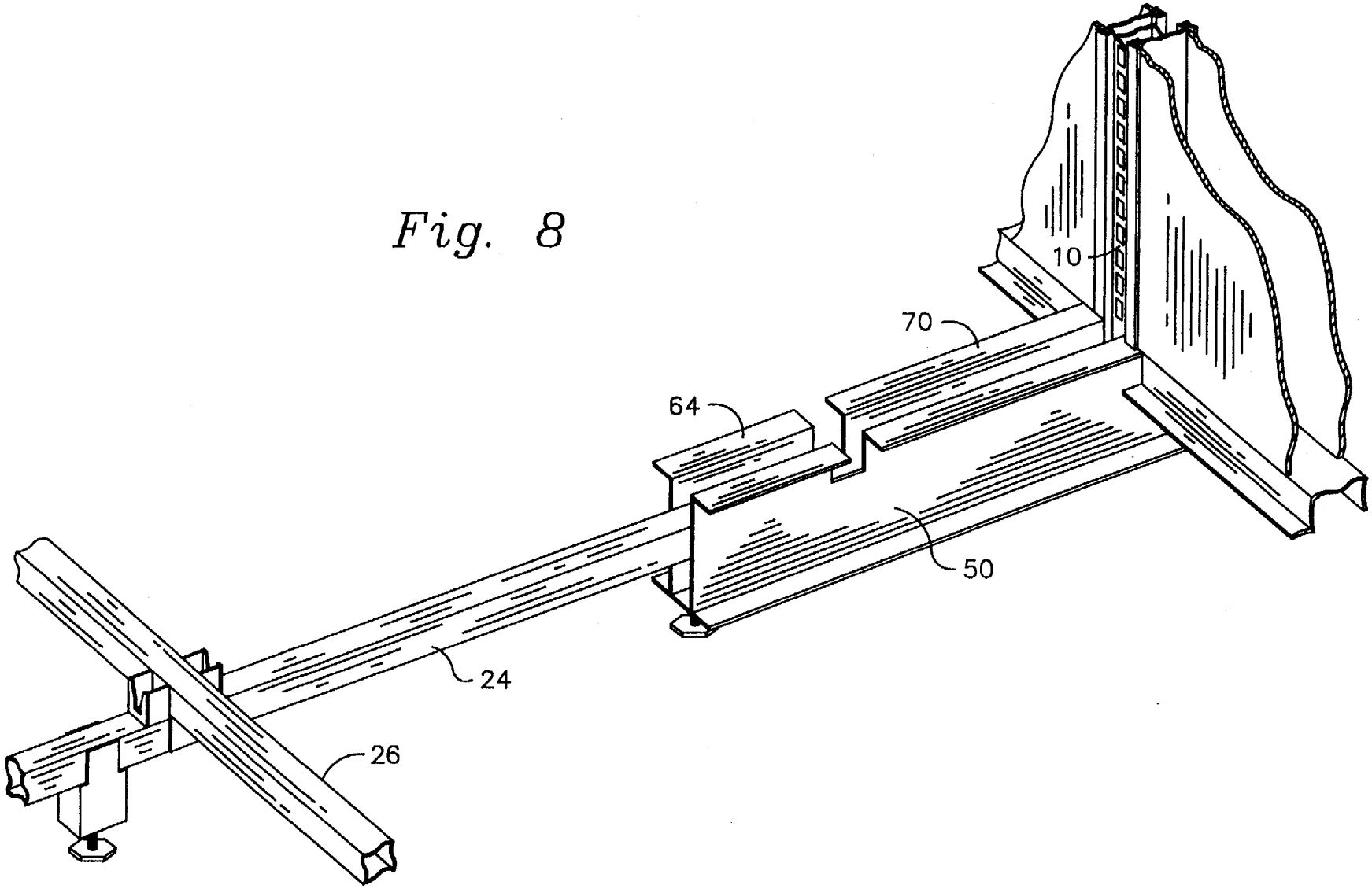
FIG. 8 is a fragmentary perspective view showing an upright post on another wall of the modular building structure, with a foot extending horizontally from the lower end of the upright post and receiving the end of a lower grid element.
Figure 9:
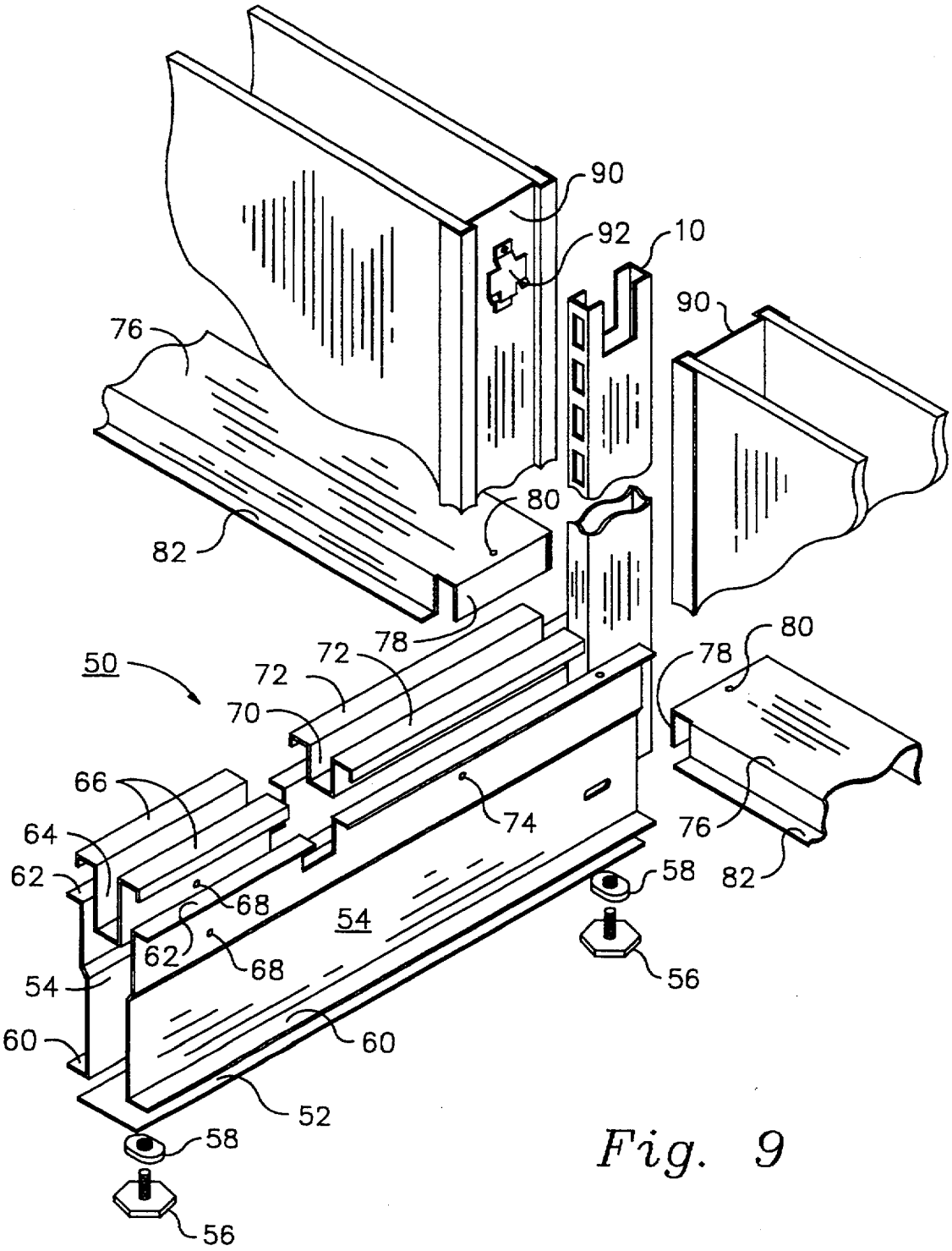
FIG. 9 is an exploded perspective view showing an upright post and stiffeners connecting adjacent posts, and illustrating the details of a foot extending horizontally from the lower end of the post;.

FIG. 9 shows that foot 50 is generally I-shaped in cross section and has a base 52 and two sheet metal elements 54, which have flanges 60 along their lower edges. These flanges are welded to base 52 so that elements 54 are situated in spaced relationship to each other, as shown in FIGS. 7 and 8. Base 52 is provided with leveling screws 56 threaded into nuts 58, welded to the base element. The leveling screws are used to adjust the vertical position of the foot 50 relative to grid 8 so that it can properly receive grid elements 24 or 26. Upper flanges 62 are provided at the upper edges of elements 54.

Foot 50 is provided with two separate channels, 70 and 64, for receiving and supporting the upper and lower grid elements 24 and 26 respectively. Channel 64 is located between elements 54 remote from upright post 10, and has flanges 66, which rest on, and are secured to, flanges 62. Aligned holes 68 are provided in elements 54 and in channel 64 for receiving a self drilling screw (not shown) used to secure a grid element 24 to the foot.

FIG. 8 shows a foot 50 receiving and supporting a lower grid element 24. The grid element extends horizontally only partially into foot 50 with its end spaced from upright post 10, and is located below the level of flanges 64.

Returning to FIG. 9, the second channel 70 is located nearer to upright post 10, with its flanges 72 resting on, and secured to, flanges located on the upper edges of elements 54. Hole 74, and a corresponding hole (not shown) in channel 70, are provided for receiving a self drilling screw (not shown) used to secure a grid element 26 to foot 50.

Channel 70 is shallower than channel 64 by an amount approximately equal to the vertical dimension of element 26 plus the thickness of the metal from which clip 44 is made. Channel 70 can therefore support an upper grid element 26 as shown in FIG. 7. The upper grid element extends substantially all the way to upright post 10, and does not rest on channel 64.

A spreader 76 provides lateral support for adjacent upright posts 10. As shown in FIG. 9, the foot elements 54 are bent so that their upper parts are slightly farther apart than their lower parts. Therefore, the upper parts are spaced from upright post 10, so that flange 78 of spreader 76 can extend downwardly into the space between the upper part of an element 54 and the upright post. A self-drilling screw (not shown) is inserted through holes 80 to secure spreader 76 to foot 50.

Each of the floor panels 6 which are adjacent to a wall parallel to the upper grid members 26, has one of its edges 32 resting on top of one of the spreaders on that wall. Each of the floor panels which are adjacent to a wall parallel to the lower grid members 24, has one of its aprons 34 resting on a support flange 82 of a spreader.

Figure 6:
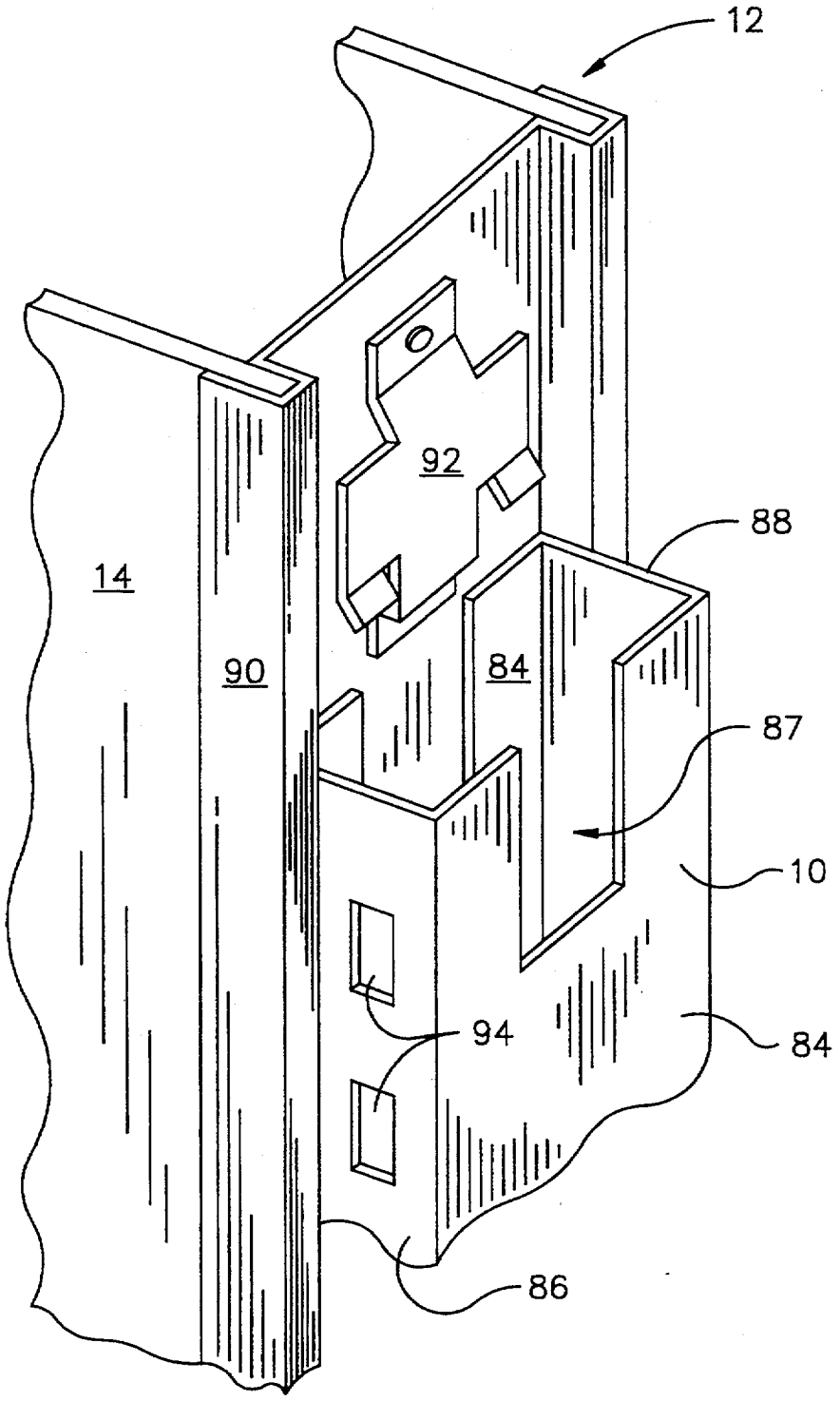
FIG. 6 is a fragmentary perspective view illustrating a wall module with a wall module supporting clip prior to interengagement with an upright post of the modular building structure.

Wall modules 12 have light gauge sheet metal frames which are attached to the upright posts in order to provide a wall around the periphery of the floor assembly 2. As shown in FIG. 6, upright post 10 has a rectangular horizontal cross-section. Upright post 10 has laterally facing opposite sides 84, a back 88, and a slotted front 86 having a vertical series of slots 94. At the upper end of the post, the laterally facing sides 84 are provided with slots 87, which are open at the top of the post. The frame 90 of wall module 12 is formed with recesses for receiving front and rear wall panels, and also with a recess on its lateral face, which conforms to and receives upright post 10. A clip 92 on frame 90 engages slot 86 to secures frame 90 to upright post 10. The clip is similar to the clip described in detail in U.S. Pat. No. 4,242,970, issued Jan. 6, 1981, the disclosure of which is incorporated by reference.

When wall modules are attached to both sides of a post 10, the vertical series of slots 94 is exposed through a space between the edges of the frames of the adjacent wall modules. Shelves having brackets with conventional slot-engaging tabs can be engaged with the slots 94 so that shelving can be removably attached to the walls at various locations and at various heights. As shown in FIG. 1, shelves 96 can be connected to slots of upright posts 10 as well as to the slots of outside corner posts 22. Shelves can be located side-by-side along a wall to provide a continuous, long shelf. Each slot 94 can receive tabs of two adjacent shelf brackets in side-by-side relationship.

Upright posts 10 are generally L-shaped. However, the inside corner post 20, see FIG. 1 generally, does not have a foot. The outside corner post 22, as shown in FIG. 1, has two feet, similar to feet 50, extending in two directions perpendicular to each other.

Wall modules 12 can contain thermal insulation or soundproofing material between their front and rear panels. Frames having doors 18 or windows 16 can be substituted for the wall modules at selected locations on the walls.

Sheet metal, channel-shaped, top caps are provided along the tops of the walls. These top caps finish off the upper edges of the walls and also help to keep the walls straight. A conventional suspended ceiling (not shown) can be attached to the existing building structure to finish off the store interior. Preferably, the suspended ceiling rests on the top caps at the upper edges of the walls.

The invention provides a modular building structure capable of being easily, quickly, and inexpensively assembled to convert an existing building, or part thereof, to a store having a new, clean and pleasing appearance. The structure can also be easily and quickly modified, or taken down altogether and transported to another location for reassembly.

Various modifications can be made to the modular building structure described above. For example, the grid structure can be made from I-beams or channels having various cross-sectional shapes, rather than tubes. Each of the vertical parts of the frames of the wall panels can be provided with multiple clips corresponding to clip 92, one above another, and the upright posts can be provided with T-shaped slots to receive the lower clips. Each upright post can also be provided with dual columns of slots for engagement by shelf brackets. The outside corner posts 20 can also be provided with shelf-supporting slots. Various articles of store furniture can be substituted for floor panels, and, if appropriately designed, can be mounted directly on the grid structure in the same manner in which the floor panels are mounted. Electrical, gas, and water connections can be made through the grid apertures above which the articles of furniture are mounted. The modular building structure can be used to provide building interiors for various uses, and is not limited to use in constructing convenience stores.

Still other modifications can be made to the modular building structure described above without departing from the scope of the invention as defined in the following claims.

I claim:

1. A modular building structure having a floor assembly, comprising:

a grid adapted to be supported on, and situated above, and in spaced relationship to, a preexisting floor; and a plurality of substantially rectangular floor panels supported on said grid;

wherein said grid comprises a first set of straight, rigid elements extending horizontally in parallel, uniformly spaced relationship to each other, and a second set of straight, rigid elements extending horizontally in parallel, uniformly spaced relationship to each other, the elements of the second set extending orthogonally to the elements of the first set, and being supported by the elements of the first set; and wherein each of said floor panels has a first pair of opposite edges, and a second pair of opposite edges, and said panels are supported in edge-to-edge relationship with one another, with the edges of the first pair supported by adjacent elements of the first set, and with the edges of the second pair supported by adjacent elements of the second set.

2. A modular building structure according to claim 1 wherein each of said floor panels has a depending, grid-engaging means extending along the edges of said first pair, with said depending, grid-engaging means resting on adjacent elements of the first set.

3. A modular building structure according to claim 1, further comprising clip means, located at intersections of the rigid elements of the first and second sets, for securing said floor panels against horizontal movement relative to one another and relative to said grid.

4. A modular building structure according to claim 3 wherein each of said clip means has a first channel for receiving one of the elements of said first set of straight, rigid elements and a second channel for receiving one of the elements of said second set of straight, rigid elements, whereby the clip means is prevented from moving horizontally relative to the elements received thereby.

5. A modular building structure according to claim 4, wherein each of said floor panels has means depending from the edges of said first pair; wherein the means depending from each edge has a downwardly open slot adjacent to a first end of the edge from which it depends, and a downwardly open slot adjacent to an opposite end of the edge from which it depends; and wherein each of said clip means comprises means for engaging downwardly open slots of four of said floor panels.

6. A modular building structure according to claim 4 wherein each of said floor panels has means depending from the edges of said first pair; and wherein each of said clip means comprises slot means for receiving depending means on four of said floor panels.

7. A modular building structure according to claim 4, wherein each of said floor panels has a depending, grid-engaging means extending along the edges of said first pair, with said depending, grid-engaging means resting on adjacent elements of the first set; wherein said depending, grid-engaging means extending along each edge of said first pair of edges comprises an apron having first and second ends, with a downwardly open slot adjacent to said first end, and a downwardly open slot adjacent to said second end; and wherein each of said clip means comprises means for engaging downwardly open slots in aprons of four of said floor panels.

8. A modular building structure according to claim 4 wherein each of said floor panels has a depending, grid-engaging means extending along the edges of said first pair, with said depending, grid-engaging means resting on adjacent elements of the first set; wherein said depending, grid-engaging means extending along each edge of said first pair of edges comprises an apron; and wherein each of said clip means comprises slot means for receiving aprons of four of said floor panels.

9. A modular building structure according to claim 1, further comprising means attached to the elements of said first set of straight, rigid elements, for adjustably leveling said grid.

10. A modular building structure comprising:

a grid adapted to be supported on, and situated above, and in spaced relationship to, a preexisting floor; and a plurality of substantially rectangular floor panels supported on said grid;

wherein said grid comprises a first set of straight, rigid elements extending horizontally in parallel, uniformly spaced relationship to each other, and a second set of straight, rigid elements extending horizontally in parallel, uniformly spaced relationship to each other, the elements of the second set being located at a level above the elements of the first set and extending orthogonally to the elements of the first set, and the elements of the first and second sets having ends; and wall means comprising a first wall including a plurality of upright posts attached to ends of the straight, rigid elements of the first set, and a second wall including a plurality of upright posts attached to ends of the straight, rigid elements of the second set wherein each of the upright posts of said first plurality of upright posts has a foot extending laterally from the first wall, each said foot having a channel receiving an end of one of the straight, rigid elements of the first set, and each of the upright posts of said second plurality of upright posts has a foot extending laterally from the second wall, each said foot of the upright posts of said first plurality having a channel receiving one of said ends of the straight, rigid elements of the second set.

11. A modular building structure according to claim 10, wherein all of the upright posts of said first and second pluralities of upright posts have substantially identical feet, each of said identical feet having first channel means capable of receiving and supporting an end of a straight, rigid element of the first set, and second channel means capable of receiving and supporting an end of a straight rigid element of the second set, and wherein the ends of the straight, rigid elements of the first set are supported in first channels of a group of said identical feet on said posts of said first plurality of upright posts, and the ends of the straight, rigid elements of the second set are supported in second channels of a group of said identical feet on said posts of said second plurality of upright posts.

12. A modular building structure according to claim 10, further comprising a plurality of wall modules secured to the upright posts of said first and second plurality of upright posts for structurally supporting said upright posts and forming walls defining a perimeter of said modular building structure.

13. A modular building structure according to claim 12, further comprising shelves having shelf brackets, and wherein said plurality of upright posts have slot means for engaging said brackets to support said shelves.

14. A modular building structure according to claim 12 wherein said wall modules have sheet metal frames.

15. A modular building structure according to claim 14, wherein at least one of said wall modules includes a window.

16. A modular building structure according to claim 14, wherein at least one of said wall modules includes a door.

17. A modular building structure having a floor assembly and a wall;

wherein the floor assembly comprises:

a grid adapted to be supported on, and situated above, and in spaced relationship to, a preexisting floor; and a plurality of substantially rectangular floor panels supported on said grid;

wherein said grid comprises a first set of straight, rigid elements extending horizontally in parallel, uniformly spaced relationship to each other, and a second set of straight, rigid elements extending horizontally in parallel, uniformly spaced relationship to each other, the elements of the second set extending orthogonally to the elements of the first set, and being supported by the elements of the first set; and wherein each of said floor panels has a first pair of opposite edges, and a second pair of opposite edges, and said panels are supported in edge-to-edge relationship with one another, with the edges of the first pair supported by adjacent elements of the first set, and with the edges of the second pair supported by adjacent elements of the second set; and wherein the wall comprises:

a first plurality of upright posts attached to ends of the straight, rigid elements of the first set, and a second plurality of upright posts attached to ends of the straight, rigid elements of the second set.

* * * * *